US011553741B2

(12) United States Patent
Malchi

(10) Patent No.: US 11,553,741 B2
(45) Date of Patent: Jan. 17, 2023

(54) ATHLETIC SHORTS WITH MOISTURE PROTECTION FEATURES AND READILY ACCESSIBLE POCKETS

(71) Applicant: Jonathan Malchi, Parkland, FL (US)

(72) Inventor: Jonathan Malchi, Parkland, FL (US)

(73) Assignee: Jonathan Malchi, Parkland, FL (US)

( * ) Notice: Subject to any disclaimer, the term of this patent is extended or adjusted under 35 U.S.C. 154(b) by 0 days.

(21) Appl. No.: 17/376,331

(22) Filed: Jul. 15, 2021

(65) Prior Publication Data

US 2022/0030961 A1 Feb. 3, 2022

Related U.S. Application Data

(60) Provisional application No. 63/058,689, filed on Jul. 30, 2020.

(51) Int. Cl.

| | |
|---|---|
| ***A41D 1/089*** | (2018.01) |
| ***A41D 27/20*** | (2006.01) |
| ***A41D 27/02*** | (2006.01) |
| ***A41D 31/10*** | (2019.01) |

(52) U.S. Cl.

CPC ..... *A41D 1/089* (2018.01); *A41D 27/201* (2013.01); *A41D 27/208* (2013.01); *A41D 31/10* (2019.02); *A41D 27/02* (2013.01); *A41D 2300/332* (2013.01); *A41D 2600/10* (2013.01)

(58) Field of Classification Search

CPC ..... A41D 27/02; A41D 27/20; A41D 27/24; A41D 1/089; A41B 2300/35; A41B 7/08

See application file for complete search history.

(56) References Cited

U.S. PATENT DOCUMENTS

| | | | | | |
|---|---|---|---|---|---|
| 597,398 | A * | 1/1898 | Devoe | A41D 1/14 | 2/211 |
| 1,220,088 | A * | 3/1917 | Gavin | A41D 3/08 | 2/88 |
| 1,330,364 | A * | 2/1920 | Wine | A41D 27/20 | 2/247 |
| 2,271,128 | A * | 1/1942 | McCoy | A41D 3/08 | 2/88 |
| 2,391,535 | A * | 12/1945 | Zelano | A41D 27/28 | 2/93 |
| 2,448,804 | A * | 9/1948 | Hutchinson | A41D 13/0012 | 2/94 |
| 2,476,585 | A * | 7/1949 | Cohen | A41C 1/02 | 2/408 |

(Continued)

FOREIGN PATENT DOCUMENTS

| | | | | |
|---|---|---|---|---|
| CN | 102019150 B | * | 4/2014 | |
| CN | 110205834 A | * | 9/2019 | |
| WO | WO-9211775 A1 | * | 7/1992 | A41D 1/205 |

*Primary Examiner* — Jillian K Pierorazio

(74) *Attorney, Agent, or Firm* — Carlson, Gaskey & Olds, P.C.

(57) ABSTRACT

This disclosure relates to athletic shorts, such as those that can be worn while playing tennis, with moisture protection features and including readily accessible pockets, such as pockets that hold tennis balls in a manner that makes those balls readily accessible during a tennis match. An example pair of shorts includes a pocket accessible via an opening, and a rib biased toward a centerline of the opening and configured to direct fluid away from the opening. This disclosure also relates to a corresponding method.

19 Claims, 4 Drawing Sheets

(56) References Cited

U.S. PATENT DOCUMENTS 2,584,577 A * 2/1952 Granert ..... A41D 27/20 2/93
3,105,973 A * 10/1963 Stiefelmeier ..... D05B 3/10 2/912
3,224,448 A * 12/1965 Diebold ..... A41C 1/003 2/408
3,281,863 A * 11/1966 Beard ..... A41D 27/24 2/113
3,296,626 A * 1/1967 Ludwikowski ..... A41D 27/28 2/87
3,572,266 A * 3/1971 Champney ..... D05B 3/10 112/65
3,707,729 A * 1/1973 Scarsella ..... A41D 3/08 2/88
3,712,308 A * 1/1973 Herbener ..... A41B 9/08 450/95
3,814,037 A * 6/1974 Nicolay ..... D05B 23/00 112/68
3,823,721 A * 7/1974 Herbener ..... A41B 9/005 2/408
3,870,000 A * 3/1975 Castany Ferre ..... D05B 39/00 2/247
4,259,751 A * 4/1981 Drmaj ..... A41D 11/00 2/269
4,549,916 A * 10/1985 Off ..... A41D 27/20 156/227
4,573,420 A * 3/1986 Carson ..... D05B 35/02 112/142
4,771,480 A * 9/1988 Stimson ..... A41D 13/1245 2/88
5,182,815 A * 2/1993 Young ..... A41D 1/089 2/406
5,415,924 A 5/1995 Herlihy, Jr.
5,442,818 A * 8/1995 Loos ..... B32B 7/14 2/164
5,568,656 A * 10/1996 Kim ..... A41D 19/001 2/167
5,592,697 A 1/1997 Young
5,598,586 A * 2/1997 Munjone ..... A41D 1/08 2/237
5,878,441 A 3/1999 Busker et al.
6,023,789 A 2/2000 Wilson et al.
6,237,152 B1 5/2001 Gootrad
7,437,774 B2 10/2008 Baron et al.
8,938,815 B2 1/2015 Vaughn
9,271,532 B2 3/2016 Cole
10,555,572 B2 * 2/2020 Diakonov ..... A41F 9/00
2004/0083529 A1 5/2004 Tate
2006/0137077 A1* 6/2006 Hosogai ..... A41D 15/005 2/247
2007/0074329 A1* 4/2007 Marshall ..... A41D 3/08 2/69
2009/0000006 A1* 1/2009 Mitchell ..... A41D 27/28 2/243.1
2010/0099332 A1* 4/2010 Noel ..... A41B 9/08 450/27
2011/0094017 A1* 4/2011 Strange ..... A41B 17/00 2/401
2011/0203034 A1* 8/2011 Shlafer ..... A41D 27/208 2/247
2012/0227164 A1* 9/2012 Komoriya ..... A41D 27/245 2/400
2013/0153119 A1* 6/2013 Hannon ..... B29C 66/729 156/308.4
2013/0276210 A1* 10/2013 Clarke ..... A41D 1/14 2/220
2013/0283494 A1* 10/2013 Vaughn ..... A41D 1/14 2/69
2013/0305433 A1 11/2013 Hedrick
2013/0318679 A1* 12/2013 Esquer ..... A41D 3/08 2/84
2014/0182044 A1* 7/2014 Cole ..... A41D 1/089 2/69
2014/0196194 A1* 7/2014 Clarke ..... A41D 1/14 2/237
2014/0197214 A1* 7/2014 Simmer ..... A41D 1/18 224/160
2014/0259297 A1* 9/2014 Garabedian ..... A41D 27/207 2/250
2015/0257459 A1* 9/2015 Cockram ..... A41D 27/20 2/237
2016/0095367 A1* 4/2016 Curran ..... A41D 27/285 2/243.1
2016/0295933 A1 10/2016 Herbener et al.
2016/0302587 A1* 10/2016 Simmer ..... A47D 13/02
2016/0331053 A1* 11/2016 Gordon ..... A41D 7/00
2017/0119065 A1* 5/2017 Boyle ..... A41D 27/204
2017/0202287 A1* 7/2017 Walter ..... A41D 27/20
2017/0354192 A1* 12/2017 Albano ..... A41D 27/207
2018/0064236 A1* 3/2018 Wolfe ..... A41D 27/20
2018/0070654 A1* 3/2018 McGargill ..... A41D 1/089
2018/0303249 A1* 10/2018 Simmer ..... A41D 1/18
2018/0332904 A1* 11/2018 Rendone ..... A41C 3/0035
2019/0029345 A1* 1/2019 Marchetto ..... A41D 27/24
2019/0060604 A1* 2/2019 Smith ..... A41D 1/06
2019/0159537 A1 5/2019 Blythe
2019/0223522 A1* 7/2019 Cano ..... A41B 17/00
2019/0364992 A1* 12/2019 Thomas ..... A41D 13/1245
2020/0054345 A1* 2/2020 Chenegros ..... A61B 17/1322
2020/0068958 A1* 3/2020 Yabarafundi ..... A41B 9/001
2020/0229516 A1* 7/2020 Curran ..... A41D 1/06

* cited by examiner

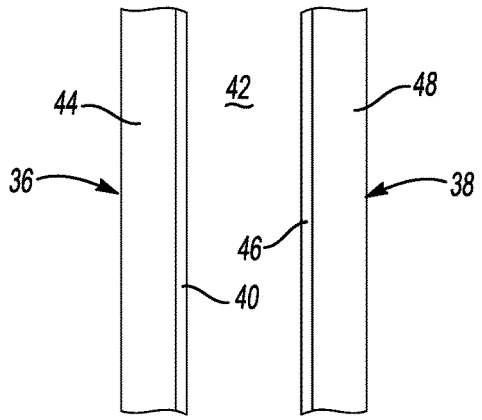
Fig-4
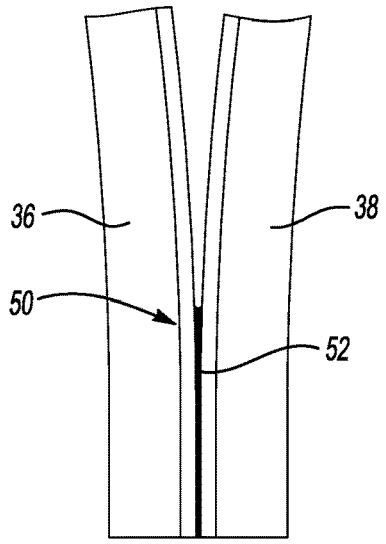
Fig-5
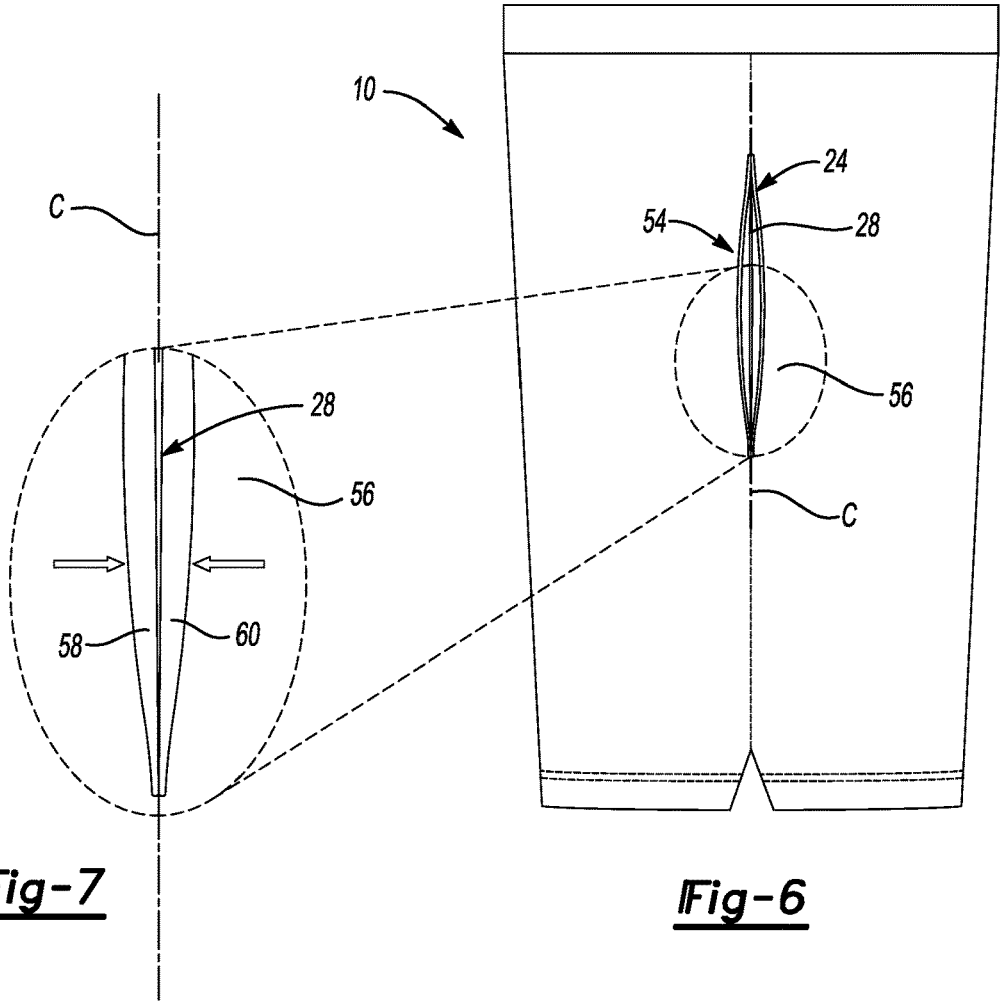
Fig-7
Fig-6

ATHLETIC SHORTS WITH MOISTURE PROTECTION FEATURES AND READILY ACCESSIBLE POCKETS

RELATED APPLICATION(S)

This application claims the benefit of U.S. Provisional Application No. 63/058,689, filed Jul. 30, 2020, the entirety of which is herein incorporated by reference.

TECHNICAL FIELD

This disclosure relates to athletic shorts, such as those that can be worn while playing tennis, with moisture protection features and including readily accessible pockets, such as pockets that hold tennis balls in a manner that makes those balls readily accessible during a tennis match.

BACKGROUND

Shorts are a garment worn over the pelvic area, circling the waist and splitting to cover the upper part of the legs, sometimes extending down to the knees but not covering the entire length of the leg. Shorts are typically worn in warm weather or in an environment where comfort and air flow are more important than the protection of the legs. Individuals engaging in athletic activities often wear sport-specific shorts. Tennis shorts, for example, typically include pockets which are sized and configured to hold one or more tennis balls such that a player may access those balls throughout a match.

SUMMARY

A pair of shorts according to an exemplary aspect of the present disclosure includes, among other things, a pocket accessible via an opening, and a rib biased toward a centerline of the opening and configured to direct fluid away from the opening.

In a further embodiment, the rib is a single rib circumscribing the entire opening.

In a further embodiment, the rib projects outward of adjacent material of the pair of shorts, and the adjacent material is material providing a pelvis portion of the pair of shorts.

In a further embodiment, the rib exhibits a maximum height at a point along a width of the rib closer to the centerline than the adjacent material, the rib exhibits a relatively flat vertical face facing the centerline, and, on the opposite side of the point as the centerline, the contour of the rib exhibits an inflection point and gradually reduces in height until it substantially matches the height of the adjacent material.

In a further embodiment, the rib exhibits substantially semi-circular cross-section having a maximum height at a midpoint of a width of the rib.

In a further embodiment, the rib is a first rib, the pair of shorts further comprises a second rib biased toward the centerline and configured to direct fluid away from the opening, and the first and second ribs are on opposite sides of the centerline.

In a further embodiment, when at rest, the first and second ribs are biased toward the centerline, the first and second ribs contact one another, and the first and second ribs do not fully enclose the pocket.

In a further embodiment, the rib is 100% polyurethane.

In a further embodiment, a liner is configured to hold contents placed in the pocket. The liner includes a first piece of material, and the first piece of material includes an inner layer facing an interior of the pocket and made of a waterproof material. Further, the first piece of material includes an outer layer on an opposite side of the inner layer as the interior of the pocket.

In a further embodiment, the first piece of material is rolled to provide the rib.

In a further embodiment, the liner includes a second piece of material connected to the first piece of material, the second piece of material includes an inner layer facing the interior of the pocket and made of a waterproof material, and the second piece of material further includes an outer layer on an opposite side of the inner layer as the interior of the pocket.

In a further embodiment, the first and second pieces of material are joined together at an interface using adhesive and not using stitching.

In a further embodiment, the inner layers of the first and second pieces of material are made of 100% polyurethane, and the outer layers of the first and second pieces of material are made of at least 92% polyethersulfone.

In a further embodiment, the pair of shorts does not include any fasteners configured to close the opening and the pair of shorts does not include any flaps configured to cover the opening.

In a further embodiment, the pair of shorts includes a pelvis portion, a right leg portion, and a left leg portion. Further, a material providing an outer layer of the pelvis portion, an outer layer of the right leg portion, and an outer layer of the left leg portion is water resistant.

In a further embodiment, the material is hydrophobic and is not waterproof.

In a further embodiment, the material is a blend of 92% polyethersulfone and 8% polyurethane.

In a further embodiment, the pocket is a right pocket of the pair of shorts, the pair of shorts further comprises a left pocket, the left pocket is accessible via an opening, and a rib is biased toward a centerline of the opening of the left pocket and is configured to direct fluid away from the opening of the left pocket.

A method according to an exemplary aspect of the present disclosure includes, among other things, retrieving a tennis ball from a pocket of a pair of shorts during a tennis match by imparting a force to a rib surrounding an opening to the pocket to overcome a bias force of the rib toward a centerline of the opening. The rib is also configured to direct fluid away from the opening.

BRIEF DESCRIPTION OF THE DRAWINGS

FIG. 4 is a cross-sectional view taken along line 4-4.

FIG. 5 is a cross-sectional view taken along line 5-5.

FIG. 6 is a side view of the example pair of shorts.

FIG. 7 is close-up view of the encircled area of FIG. 6.

DETAILED DESCRIPTION

Figure 1:
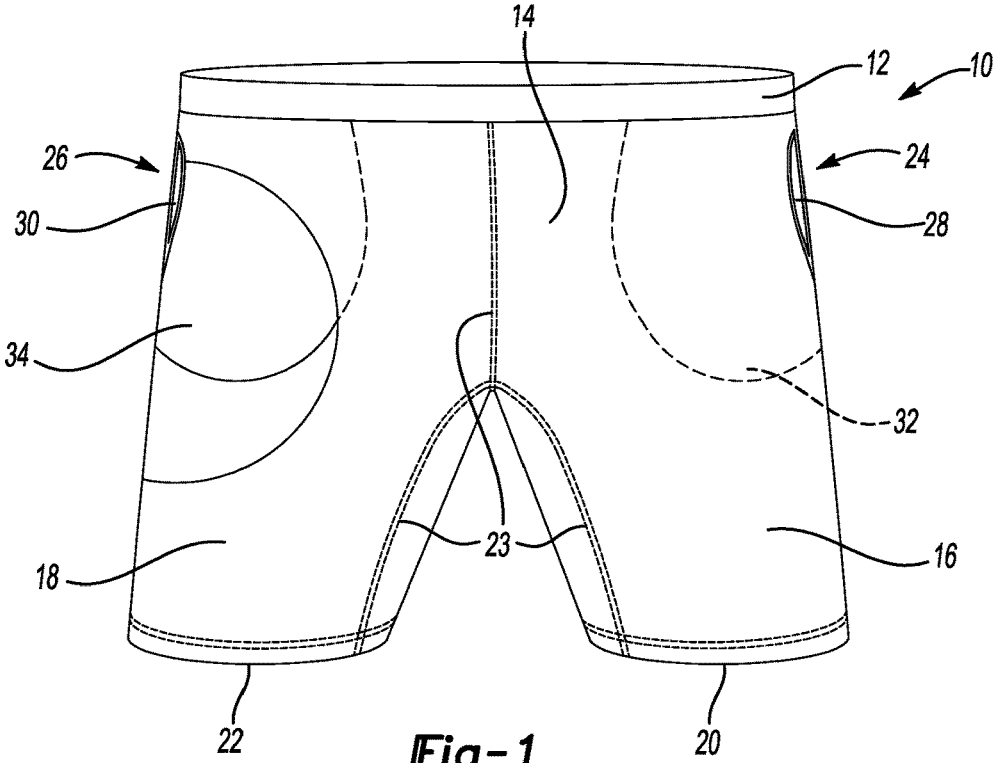
FIG. 1 is a front view of an example pair of shorts.

FIG. 1 is a front view of an example pair of shorts 10 according to the present disclosure. Adjacent a top thereof (i.e., in the upward direction, relative to FIG. 1), the shorts 10 include a waistband 12, which may be stretchable, providing an opening configured to fit around the waist, or torso, of a user (i.e., the individual wearing the shorts 10). Below the waistband 12 (i.e., in the downward direction, relative to FIG. 1), the shorts 10 include a pelvis portion 14 configured to fit around a pelvis of the user. Moving further downward, the pelvis portion 14 splits into a left leg portion 16 and a right leg portion 18. The left and right leg portions 16, 18 are configured to receive a portion of the left and right legs of a user, respectively. Thus, when viewed from the front, as in FIG. 1, the left leg portion 16 is on the right-hand side of the figure, and the right leg portion 18 is on the left-hand side of the figure. The shorts 10, and in turn the left and right leg portions 16, 18, are substantially symmetrical.

The left and right leg portions 16, 18 include openings at terminal ends 20, 22, respectively. The openings allow the lower portions of a user's legs to project through the left and right leg portions 16, 18. The left and right leg portions 16, 18 are sized such that the terminal ends 20, 22 rest generally at or around the knee of a user. The terminal ends 20, 22 do not extend to locations adjacent the ankles of the user.

The shorts 10 may include various seams 23 connecting pieces of fabric together to form the shorts 10, namely the waistband 12, pelvis portion 14, and left and right leg portions 16, 18. The seams 23 may be formed by stitching and/or threading. Seams 24 are not present in all examples. The shorts 10 could be made using seamless techniques, such as by connecting the pieces of fabric using adhesives.

In one aspect of this disclosure, the material (labeled and discussed as material 56 below) that provides the outer layer of the pelvis portion 14 and the outer layer of the left and right leg portions 16, 18 is water resistant. In particular, the material is such that water and/or sweat coming into contact with the material beads up such that the shorts 10 do not saturate during use. In an example, the material is hydrophobic, such that it is resistant to water without being fully waterproof, and thus the material largely resists water without having some of the setbacks of fully waterproof material, which can be uncomfortably hot and overly restrictive. On the contrary, the material is breathable, largely water resistant, and stretchy, which is particularly useful when the shorts are worn during athletic activities such as tennis. Even more specifically, the material exhibits a steam transmission capacity (breathability) of greater than or equal to 7,000 $g/m^2/24$ h (determined by testing standard AATCC204), a water repellency of at least 70% (determined by testing standard AATCC 22), and a recovery of 80% (determined by testing standard ASTM D6614). The material also exhibits colorfastness against salt water and chlorine, having a minimum of 4 on the grey scale (determined by testing standards AATCC 106 and 162), and blocks UV radiation, having greater than or equal to 30 UPF (determined by testing standard AATCC 183). An example material which achieves the above benefits is a blend of 92% polyethersulfone (PES) and 8% polyurethane (PU).

A number of aspects of this disclosure relate to pockets of the shorts 10, and in particular to side pockets of the shorts 10. For example, in FIG. 1, the shorts 10 include left and right pockets 24, 26. The left and right pockets 24, 26 include openings 28, 30 leading to respective liners 32, 34 which rest inside the shorts 10, between a front of the user's legs and the interior of the shorts 10 (e.g., the interior of the pelvis portion 14). The liner 32 of the left pocket 24 is shown in phantom in FIG. 1, while the liner 34 of the right pocket 26 is partially visible in FIG. 1 by virtue of some of the material of the pelvis portion 14 and right leg portion 18 being omitted from the drawing for purposes of illustration only.

The liners 32, 34 serve as pouches for holding articles placed into the left and right pockets 24, 26. In this disclosure, the left and right pockets 24, 26 are especially configured for holding tennis balls. In particular, each pocket 24, 26 may be configured to comfortably hold at least two regulation sized tennis balls.

Figure 2:
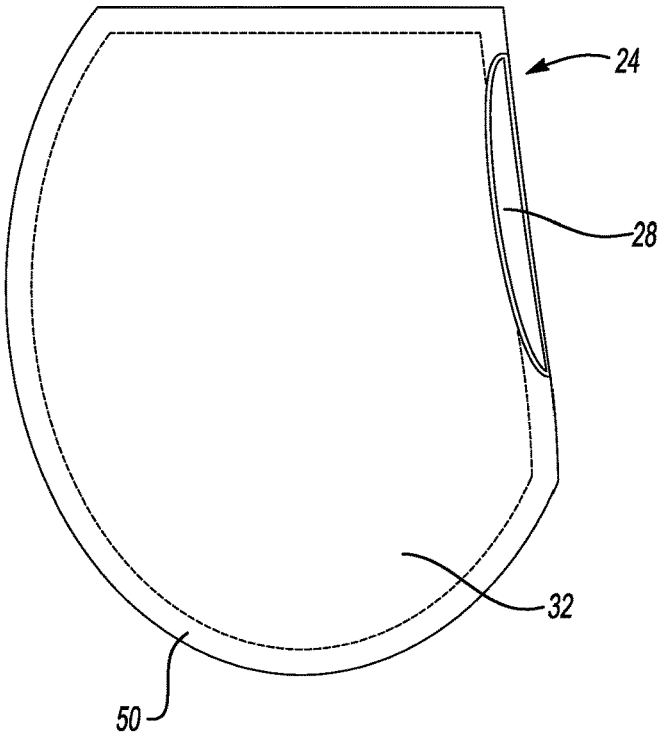
FIG. 2 is a front view of an example pocket, illustrated without the remainder of the shorts for ease of reference.
Figure 3:
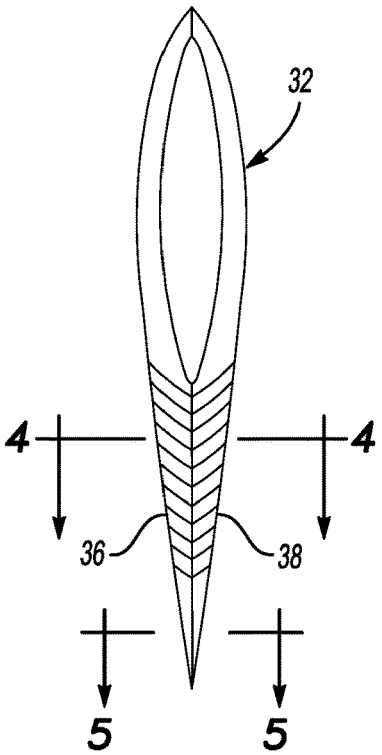
FIG. 3 is a side view of the example pocket.

Each of the liners 32, 34 may be formed by combining two substantially identically-shaped pieces of material. The pieces of material are made of fabric that makes the liners 32, 34 waterproof but also breathable/comfortable when in contact with a user's legs. FIGS. 2-4, for example, illustrate the left pocket 24 and liner 32 in detail. In FIG. 3, for example, first and second pieces of material 36, 38 are illustrated. The first and second pieces of material 36, 38 are substantially identically-shaped and are connected together to form the liner 32. In FIG. 4, the detail of the first and second pieces of material 36, 38 are shown.

With reference to the first piece of material 36, it includes an inner layer 40 facing an interior 42 of the left pocket 24 and an outer layer 44 attached to the inner layer 40 on an opposite side of the inner layer 40 as the interior 42. In one example, the inner layer 40 is made of a waterproof membrane, and in particular may be 100% PU. In that example, the outer layer 44 may be 100% PES. Alternatively, the outer layer 44 may be provided by the same material discussed above that provides the material of the pelvic portion 14 and the left and right leg portions 16, 18, for example. The second piece of material 38 includes an inner and outer layer 46, 48 substantially identical to the corresponding layers of the first piece of material 36. The inner layers 40, 46 protect the contents of the liner 32 from exposure to moisture, while the outer layers 44, 48 provide comfort and breathability, which is beneficial because the outer layers 44, 48 may contact a user's leg. Thus, the liners 32, 34 protect the contents of the liners 32, 34, such as tennis balls, from exposure to moisture without compromising comfort. In a particular example, the first and second pieces of material 36, 38 exhibit the following: water leakage of maximum 1 g (impermeability) (determined by testing standard AATCC35), a water impermeability of at least 18,000 $g/m^2/24$ h (determined by testing standard JIS L1092), breathability of at least 15,000 $mmH_2O$ (determined by testing standard JIS L1099), a water repellency of at least 70% (determined by testing standard AATCC 22), and an air permeability of less than or equal to 3 $ml/s/cm^2$ (determined by testing standard ASTM D737).

With reference to FIG. 2, the first and second pieces of material 36, 38 are joined together at an interface 50, which extends around the entire perimeter of the liner 32 except for the area around the opening 28. The interface 50 is not provided by stitching in this disclosure. Rather, as shown in FIG. 5, an adhesive 52 is provided between the first and second pieces of material 36, 38. The adhesive 52 is heat sealed at a particular temperature and pressure to provide a sufficient bond between the pieces of material 36, 38. Because stitches are not used, the first and second pieces of material 36, 38 are not punctured, and thus the waterproof properties of the first and second pieces of material 36, 38 are not compromised.

A further aspect of this disclosure relates to the openings 28, 30, and in particular to a rib structure surrounding the openings 28, 30 and biased toward a centerline of the openings 28, 30 (i.e., the rib structure biases the openings 28, 30 toward a closed position) and serves to direct water and/or sweat away from the openings 28, 30. The centerlines of the openings run in the upward-and-downward, or vertical, direction, in this example.

With reference to FIGS. 6 and 7, a rib structure, or rib assembly, 54 surrounds the opening 28. A substantially identical rib structure surrounds the opening 30. The rib structure 54 circumscribes the opening 28. In a particular example, the rib structure 54 projects outward from the material, labeled 56 in FIGS. 6-10, providing the material of the pelvis portion 14 of the shorts 10 adjacent the opening 28. The rib structure 54 may include a first rib 58 and a second rib 60 on opposite sides of a centerline C of the opening 28. Alternatively, a single rib can circumscribe the entire opening 28. The first and second ribs 58, 60 may be made of an elastomeric or polymer material, in some examples. In another example, the first and second ribs 58, 60 are made of the same material providing the inner layers 40, 46. In particular, the first rib 58 could be formed by rolling the first piece of material 36 over until it forms a rib, with the inner layer 40 surrounding the outer layer 44. The second rib 60 could be formed in the same manner using the second piece of material 38. Alternatively, the first and second ribs 58, 60 could be provided by pieces of elastomeric material which are formed separately and attached to the shorts 10.

The first and second ribs 58, 60 are configured such that when they are at rest, without external forces applied to thereto, the first and second ribs 58, 60 are biased toward one another and toward the centerline C of the opening 28. At rest, the first and second ribs 58, 60 may contact one another. In this manner, the first and second ribs 58, 60 work to contain the contents of the left pocket 24. However, when at rest, the first and second ribs 58, 60 do not fully enclose the left pocket 24. Further, there are no fasteners, such as Velcro, zippers, buttons, clasps, etc., that bind the edges of the opening 28 to hold the left pocket 24 closed. Even further, there are no flaps configured to lie over the opening. Rather, the opening 28 is exposed and readily accessible from the outside of the shorts 10 without requiring the user to first move a flap or undo a fastener, for example.

While reliably containing the contents of the pockets, when a force is applied to the ribs 58, 60 by a user's hand or by a user pushing or pulling a tennis ball relative to the ribs 58, 60, as examples, the ribs 58, 60 are readily pulled apart from one another. In this way, the opening 28 reliably holds its contents while still providing easy access to the contents of the left pocket 24. The openings 28, 30 make the shorts 10 particularly suited for use when playing tennis, as the user repeatedly puts tennis balls into the pockets 24, 26 and pulls balls out of the pockets 24, 26 during play.

Figures 8, 9, 10:
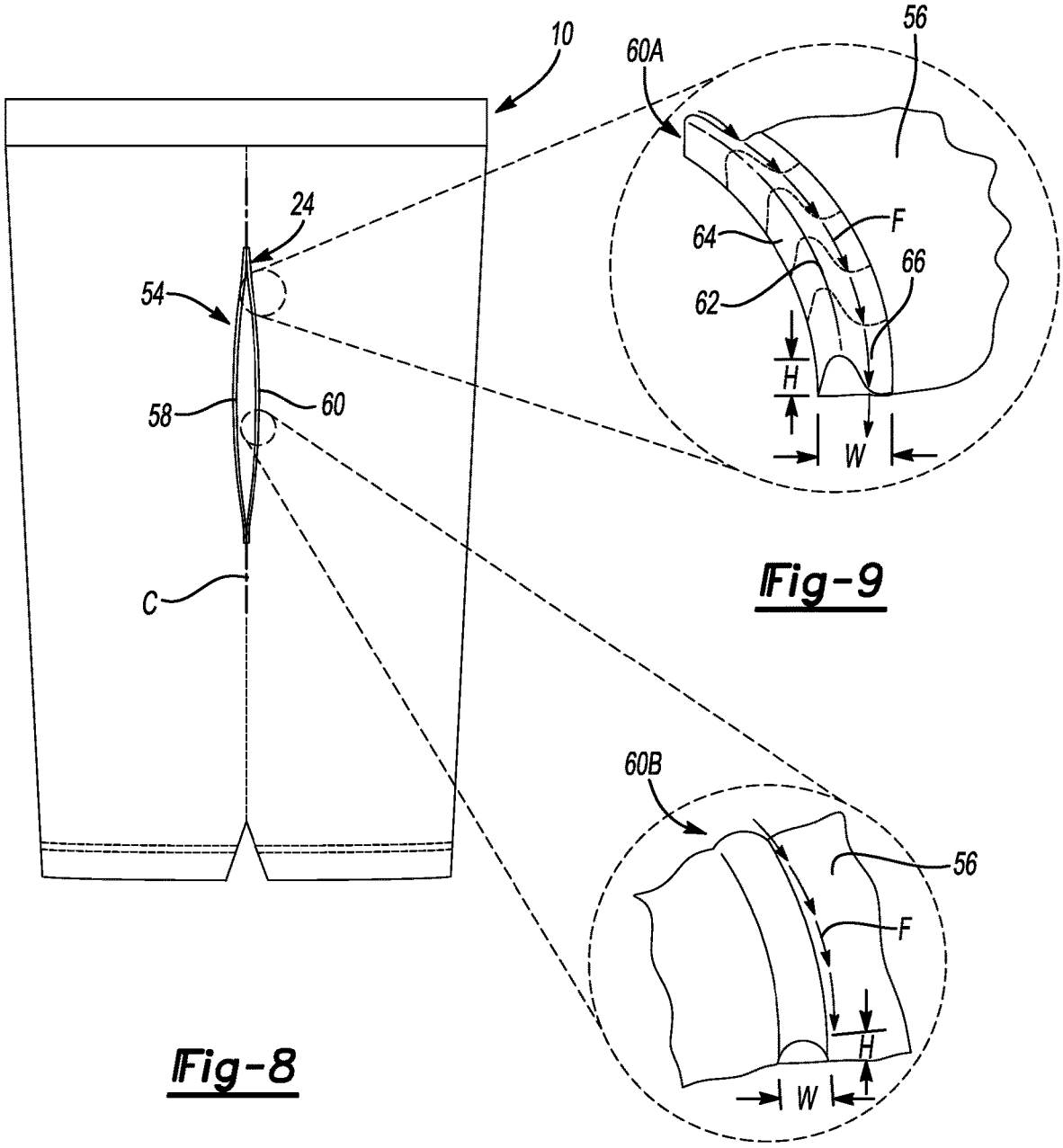
FIG. 8 is a side view of the example pair of shorts.
FIG. 9 is close-up view of an encircled area of FIG. 8 and illustrates a first example rib configuration.
FIG. 10 is close-up view of another encircled area of FIG. 8 and illustrates a second example rib configuration.

The rib structure 54 also serves to divert sweat and/or water away from the opening 28. With reference to FIGS. 8-10, the rib structure 54 projects outward of the material 56. Thus, sweat and/or water flowing toward the opening 28 along the material 56 is diverted away from the openings 28. Thus, despite the openings 28, 30 not having fasteners configured to close and seal the openings 28, 30, sweat and water does not easily enter the openings 28, 30.

FIG. 9 illustrates a first example rib configuration (i.e., an example configuration of rib 60). In FIG. 9, the rib 60A exhibits a maximum height H at a point 62 along its width W closer to the centerline C than the material 56. The rib 60A has a relatively flat vertical face 64 facing the centerline C and, on the opposite side of the point 62 as the centerline C, the contour of the rib 60A exhibits an inflection point 66 and gradually reduces in height until it substantially matches the height of the material 56.

Another example rib configuration is shown in FIG. 10. In FIG. 10, the rib 60B is substantially semi-circular in cross-section having a maximum height H at approximately the midpoint of its width W.

The outer surface of the rib configurations 60A, 60B is provided by waterproof material. Further, the shape of the example rib configurations 60A, 60B is configured to direct sweat and/or water (i.e., fluid) F away from the opening 28. While two example configurations are shown relative to the same rib 60, the rib 60 would in practice only exhibit one configuration along its length. Further, the rib configurations 60A, 60B are representative of example configurations of the rib 58, as well the ribs surrounding the opening 30. Even further, while two rib configurations are shown and described, additional rib configurations come within the scope of this disclosure.

Figure 11:
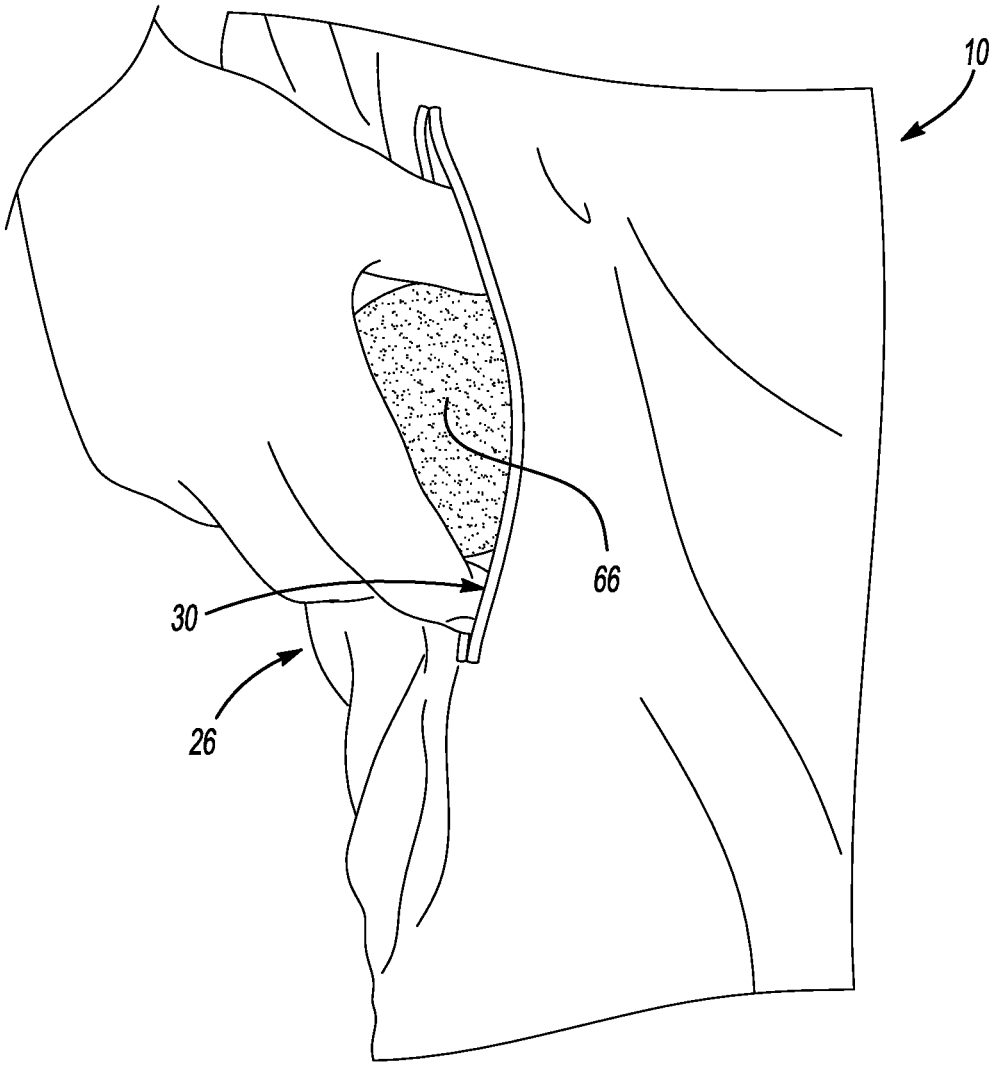
FIG. 11 is a partial side view of an example pair of shorts, and in particular illustrates a user placing a tennis ball in a right pocket of the shorts.

FIG. 11 is a partial side view of the shorts 10, and illustrates a user placing a tennis ball 66 in a right pocket 26 of the shorts 10. The opening 30 includes a rib structure configured substantially the same as the rib structure 54, and in this example exhibits substantially the same configuration as rib configuration 60B. As the user places the ball 66 into the right pocket 26, the ball 66 forces the ribs away from the centerline of the right pocket 26 such that the ball 66 can enter into the pocket 26 and be held in place by the liner 34 (not shown in FIG. 11). Once the ball 66 passes the threshold of the opening 30, the ribs move to a resting position, toward the centerline of the opening 30, to assist with maintaining the ball 66 in the right pocket 26 and diverting water/sweat away from the right pocket 26. To retrieve the ball 66, the user uses his or her hand to pull the ball 66 out of the right pocket 26. The user's hand can easily spread apart the ribs, retrieve the ball 66, and, once the ball 66 is retrieved, the ribs again return to the resting position. While tennis is mentioned numerous times herein, the shorts 10 could also be used relative to other activities, including running, as one example.

It should be understood that directional terms such as "upward" and "downward," etc., are used herein for purposes of explanation and should not be considered otherwise limiting. Terms such as "generally," "substantially," and "about" are not intended to be boundaryless terms, and should be interpreted consistent with the way one skilled in the art would interpret those terms.

Although the different examples have the specific components shown in the illustrations, embodiments of this disclosure are not limited to those particular combinations. It is possible to use some of the components or features from one of the examples in combination with features or components from another one of the examples. In addition, the various figures accompanying this disclosure are not necessarily to scale, and some features may be exaggerated or minimized to show certain details of a particular component or arrangement.

One of ordinary skill in this art would understand that the above-described embodiments are exemplary and non-limiting. That is, modifications of this disclosure would come within the scope of the claims. Accordingly, the following claims should be studied to determine their true scope and content.

The invention claimed is:

1. A pair of shorts, comprising:

a pocket accessible via an opening;

a liner configured to hold contents placed in the pocket; and a rib biased toward a centerline of the opening and configured to direct fluid away from the opening, wherein the rib is formed by rolling material forming the liner.

2. The pair of shorts as recited in claim 1, wherein the rib projects outward of adjacent material of the pair of shorts, wherein the adjacent material is material providing a pelvis portion of the pair of shorts.

3. The pair of shorts as recited in claim 2, wherein:

the rib exhibits a maximum height at a point along a width of the rib closer to the centerline than the adjacent material, the rib exhibits a relatively flat vertical face facing the centerline, and on the opposite side of the point as the centerline, the contour of the rib exhibits an inflection point and gradually reduces in height until it substantially matches the height of the adjacent material.

4. The pair of shorts as recited in claim 1, wherein:

the rib is a first rib, the pair of shorts further comprises a second rib biased toward the centerline and configured to direct fluid away from the opening, wherein the second rib is formed by rolling material forming the liner, and the first and second ribs are on opposite sides of the centerline.

5. The pair of shorts as recited in claim 4, wherein, when at rest:

the first and second ribs are biased toward the centerline, the first and second ribs contact one another, and the first and second ribs do not fully enclose the pocket.

6. The pair of shorts as recited in claim 1, wherein the rib is 100% polyurethane.

7. The pair of shorts as recited in claim 1, further comprising:

wherein the liner includes a first piece of material, wherein the first piece of material includes an inner layer facing an interior of the pocket and made of a waterproof material, wherein the first piece of material further includes an outer layer on an opposite side of the inner layer as the interior of the pocket, wherein the rib is formed such that the inner layer provides an exterior of the rib.

8. The pair of shorts as recited in claim 7, wherein:

the liner includes a second piece of material connected to the first piece of material, the second piece of material includes an inner layer facing the interior of the pocket and made of a waterproof material, and the second piece of material further includes an outer layer on an opposite side of the inner layer as the interior of the pocket.

9. The pair of shorts as recited in claim 8, wherein the first and second pieces of material are joined together at an interface using adhesive and not using stitching.

10. The pair of shorts as recited in claim 8, wherein:

the inner layers of the first and second pieces of material are made of 100% polyurethane, and the outer layers of the first and second pieces of material are made of at least 92% polyethersulfone.

11. The pair of shorts as recited in claim 1, wherein the pair of shorts does not include any fasteners configured to close the opening and the pair of shorts does not include any flaps configured to cover the opening.

12. The pair of shorts as recited in claim 1, further comprising:

a pelvis portion, a right leg portion, and a left leg portion, wherein a material providing an outer layer of the pelvis portion, an outer layer of the right leg portion, and an outer layer of the left leg portion is water resistant.

13. The pair of shorts as recited in claim 12, wherein the material is hydrophobic and is not waterproof.

14. The pair of shorts as recited in claim 13, wherein the material is a blend of 92% polyethersulfone and 8% polyurethane.

15. The pair of shorts as recited in claim 1, wherein:

the pocket is a right pocket of the pair of shorts, the pair of shorts further comprises a left pocket, the left pocket is accessible via an opening, and a rib is biased toward a centerline of the opening of the left pocket and is configured to direct fluid away from the opening of the left pocket.

16. A pair of shorts, comprising:

a waistband, a pelvis portion, a right leg portion, a left leg portion, wherein a material providing an outer layer of the pelvis portion, an outer layer of the right leg portion, and an outer layer of the left leg portion is water resistant and is not waterproof, wherein the right leg and left leg portions each include a pocket, each pocket being accessible by a respective opening and comprising:

a rib biased toward a centerline of the respective opening and configured to direct fluid away from the respective opening, wherein the rib projects outward of adjacent material of the pair of shorts, a liner configured to hold contents placed in the pocket, wherein the liner includes a first piece of material, wherein the first piece of material includes an inner layer facing an interior of the pocket and made of a waterproof material, and wherein the first piece of material further includes an outer layer on an opposite side of the inner layer of the first piece of material as the interior of the pocket, wherein the liner further includes a second piece of material connected to the first piece of material, and wherein the second piece of material includes an inner layer facing the interior of the pocket and made of a waterproof material, and wherein the second piece of material further includes an outer layer on an opposite side of the inner layer of the second piece of material as the interior of the pocket, wherein the first and second pieces of material are joined together at an interface using adhesive and not using stitching, and wherein the pair of shorts does not include any fasteners configured to close the opening and the pair of shorts does not include any flaps configured to cover the opening, wherein the rib is formed by rolling material of the liner.

17. The pair of shorts as recited in claim 16, wherein the rib is a first rib formed by rolling the first piece of material such that an inner layer of the first piece of material provides an exterior of the first rib.

18. The pair of shorts as recited in claim 17, wherein the pelvis portion, right leg portion, and left leg portion are made of a material different than the first and second pieces of material.

19. The pair of shorts as recited in claim 17, wherein a second rib is formed by rolling the second piece of material such that an inner layer of the second piece of material provides an exterior of the second rib, wherein the first and second ribs are on opposite sides of the pocket, and wherein the first and second ribs are biased toward one another.

* * * * *